US007976177B2

(12) United States Patent
Dikopf

(10) Patent No.: US 7,976,177 B2
(45) Date of Patent: Jul. 12, 2011

(54) INTERNALLY LIGHTED BOTTLE

(76) Inventor: Leon Dikopf, Highland Park, IL (US)

( * ) Notice: Subject to any disclaimer, the term of this patent is extended or adjusted under 35 U.S.C. 154(b) by 360 days.

(21) Appl. No.: 11/674,550

(22) Filed: Feb. 13, 2007

(65) Prior Publication Data

US 2008/0035515 A1 Feb. 14, 2008

Related U.S. Application Data

(60) Provisional application No. 60/773,245, filed on Feb. 14, 2006.

(51) Int. Cl.
*F21V 33/00* (2006.01)

(52) U.S. Cl. ..... 362/101; 362/155; 362/276; 362/802; 206/457; 215/6

(58) Field of Classification Search ..... 362/101, 362/154–156, 276, 802; 206/457; 215/6
See application file for complete search history.

(56) References Cited

U.S. PATENT DOCUMENTS 4,358,935 A 11/1982 Losert et al.
5,339,548 A 8/1994 Russell
6,086,216 A * 7/2000 Goldfarb ..... 362/101
6,254,247 B1 7/2001 Carson
6,511,196 B1 1/2003 Hoy
6,923,549 B2 8/2005 Hoy
6,964,492 B1 11/2005 Nicklowitz
7,175,294 B1 2/2007 Estrada et al.
2006/0139928 A1 * 6/2006 Griffiths et al. ..... 362/276

OTHER PUBLICATIONS

International Search Report and Written Opinion for PCT/US07/62123 mailed on Nov. 20, 2007, which claims priority to U.S. Appl. No. 60/773,245, as does the present application.

* cited by examiner

*Primary Examiner* — Stephen F Husar
(74) *Attorney, Agent, or Firm* — Patzik, Frank & Samotny Ltd.

(57) ABSTRACT

Bottles containing LED circuits positioned in LED chambers for selectively illuminating the bottle or its contents. The LED circuits can be positioned in a translucent or transparent base and can be activated so as to illuminate or cease to illuminate one or more LEDs by reed-type hermetic switches, contact switches or push switches when a base to the bottle is twisted, the bottle is opened, the bottle is closed or the bottle is lifted from a flat surface. The LED circuits can alternatively be attached to the bottle by way of a shrink-wrapped layer over the base and/or sides of the bottle with the LED Circuits interposed between the translucent shrink-wrap and the bottle.

5 Claims, 11 Drawing Sheets

INTERNALLY LIGHTED BOTTLE

CROSS-REFERENCE TO RELATED APPLICATIONS

This application claims the benefit of U.S. Provisional Patent Application No. 60/773,245, filed Feb. 14, 2006.

BACKGROUND OF THE INVENTION

The present invention relates to a bottle with the illusion of internal lighting.

There are many kinds of beverages, both alcoholic and non-alcoholic, available on the market. To differentiate the various brands and types of beverages that the consumer has an opportunity to sample or purchase, distinctive shapes, labels and colors are used on or in association with the beverage bottles.

To provide another manner of providing a pleasing or distinctive appearance to such bottles, the current invention provides a way to light such bottles safely and inexpensively to give the appearance as if such light sources are inside the bottle.

BRIEF SUMMARY OF THE INVENTION

The bottle comprises a container portion; one or more light sources for illuminating selected portions of the container portion and operably associated therewith; and, one or more switches operably connected to the light sources for selectively illuminating said light sources as desired.

The bottle can also comprise: a container portion; a base portion for receiving at least a portion of the container portion; one or more light sources contained within the base portion for illuminating the container portion; one or more switches located within the base portion and operably connected to the light sources for selectively illuminating the light sources as desired. The light sources can be Light Emitting Diodes, referred to as LEDs. The switches are reed-type hermetic switches.

The bottle of the present invention comprises a container portion; a base portion for receiving at least a portion of the container portion; one or more light sources contained within the base portion for illuminating the container portion; one or more switches located within the base portion and operably connected to the light sources for selectively illuminating the light sources as desired. The light sources are LEDs and the switches are reed-type hermetic switches.

In another embodiment of the present invention, the bottle has an outer surface and comprises: one or more LED circuits operatively associated therewith and comprising at least one of each of the following: an LED; and a power source for illuminating said LED. The LED circuits are positioned proximate the outer surface of the bottle, so as to illuminate the bottle; and, the LED circuits comprise one or more switches for selectively illuminating the LED.

In the two piece bottle embodiment, the bottle is capable of containing a liquid and comprises: a first portion comprising an inner container portion capable of containing a liquid; a second portion comprising an outer cover portion; the outer cover portion of said bottle being normally telescopically received by said inner container portion in nested fashion, so as to appear as if it is a one piece bottle. One or more LED circuits comprise at least one LED, being operably associated with the inner container portion and the outer cover portion of the bottle, so that when the first portion is separated from the second portion at least one LED is illuminated. In the 2-piece bottle embodiment, at least one LED is turned off when the second portion of the bottle is placed back together with the first bottle portion. The second portion of the bottle is capable of being used as a glass to drink the liquid contained in the first portion.

In another version of the 2-piece bottle, the bottle comprises a first bottle portion comprising an inner container portion; a second bottle portion comprising an outer cover portion; the outer cover portion of the bottle is normally telescopically received in nested fashion by the inner container portion so as to appear as if it is a one piece bottle; and, one or more LED circuits are operably associated with the inner container portion and the outer cover portion of the bottle, so that when the first portion is separated from the second portion, at least one LED is turned off. At least one LED is illuminated when the second portion of the bottle is placed back together with the first bottle portion.

In yet another embodiment, a bottle has a removable top and comprises: a detachable top; a top portion of the bottle wherein the top is connected to the bottle; and, one or more LED circuits, comprising at least one LED, is operably associated with the removable top and the top receiving portion of the bottle, wherein removal of the top from the bottle results in illumination of at least one LED.

Alternatively, a bottle having a removable top comprises: a detachable top; a top portion of the bottle wherein the top is connected to said bottle; and, one or more LED circuits, comprising at least one LED, operably associated with the removable top and the top receiving portion of the bottle, wherein removal of the top from the bottle results in turning off at least one LED.

These objects and others will become apparent based on the description and claims that follow.

BRIEF DESCRIPTION OF THE SEVERAL VIEWS OF THE DRAWINGS

Additional characteristics and advantages of the invention will become apparent from the detailed description of preferred and other embodiments of the invention, which are illustrated only by way of non-limiting examples in the accompanying drawings wherein:

FIG. 9B is a side cross-sectional view of the bottle of FIG. 9A.

DETAILED DESCRIPTION OF THE INVENTION

Figure 1:
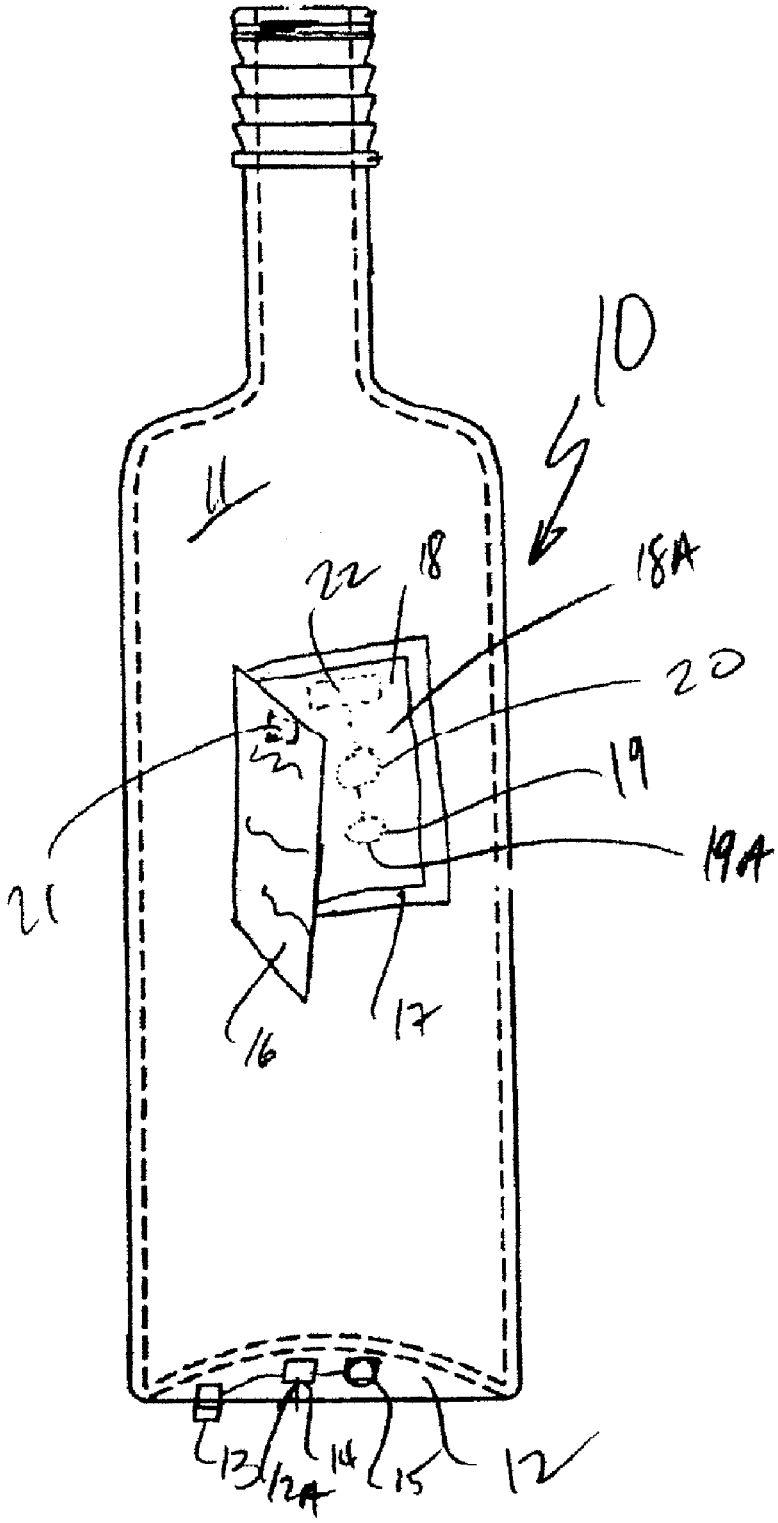
FIG. 1 is a side view of a first embodiment of the bottle.
Figure 2A:
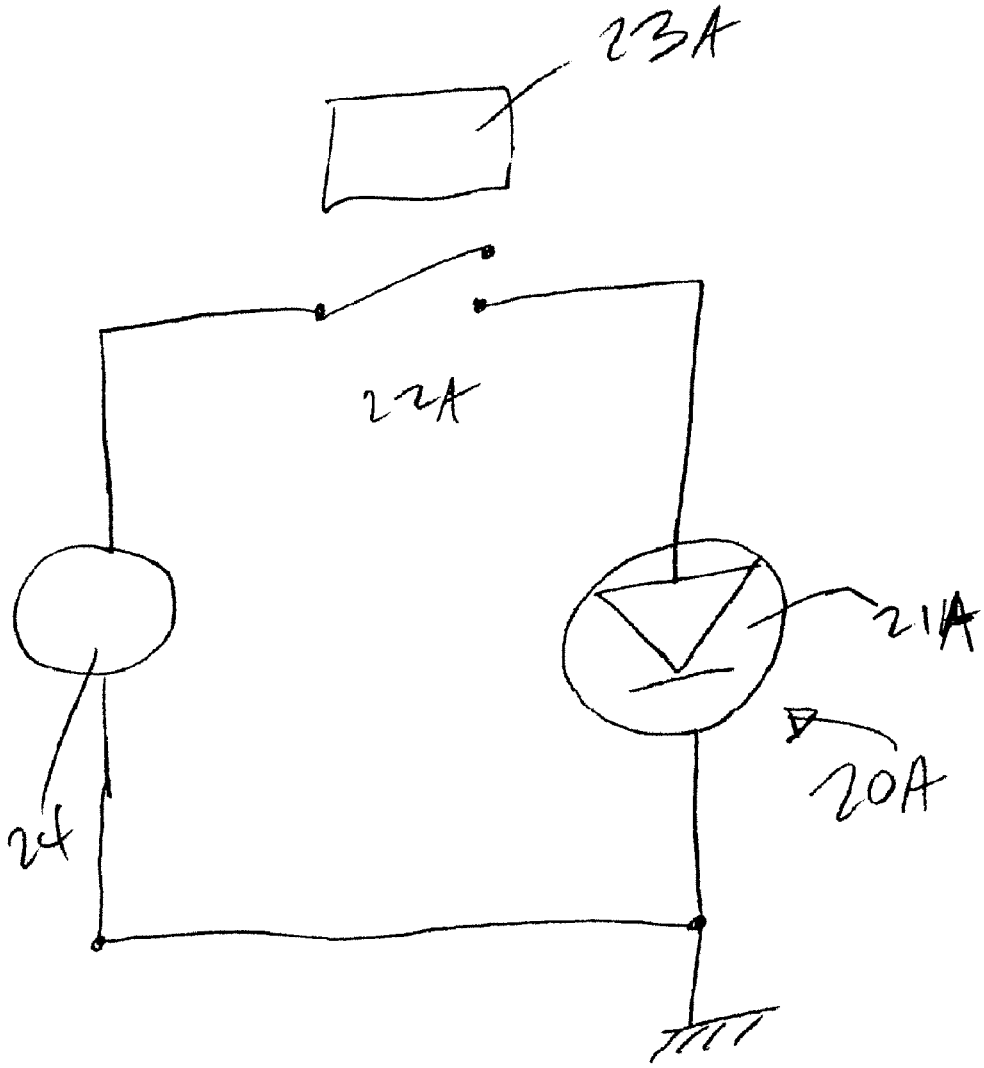
FIG. 2A is an example of a sample light emitting diode (LED) circuit that can be used in the preferred embodiment.

With reference to FIGS. 1 and 2A, a bottle according to the invention is shown as having two LED chambers 12 and 18 formed therein. Chamber 12 in the bottom and chamber 18 with opening door 16 in the side, of bottle 10, enable lighting of those portions of the bottle 10, as well as bottle interior 11, by way of LED circuits 12A and 19A of the type of LED circuit 20A shown in FIG. 2A. Bottle 10 need not have both LED circuits 12A and 19A, but can have either one. LEDs in the invention can be single or multiple; white or colored; flashing or steady; monochromatic or a variety of colors.

With respect to all of the embodiments of the invention described herein, the LED circuit 20A will comprise a power source such as a 1.5v hearing aid or watch batter 24, a contact switch such as reed-type contact switch 22A, magnet 23A and LED 21A, though other LED circuitry and components could be used and still not depart from the scope of this invention.

Figure 2B:
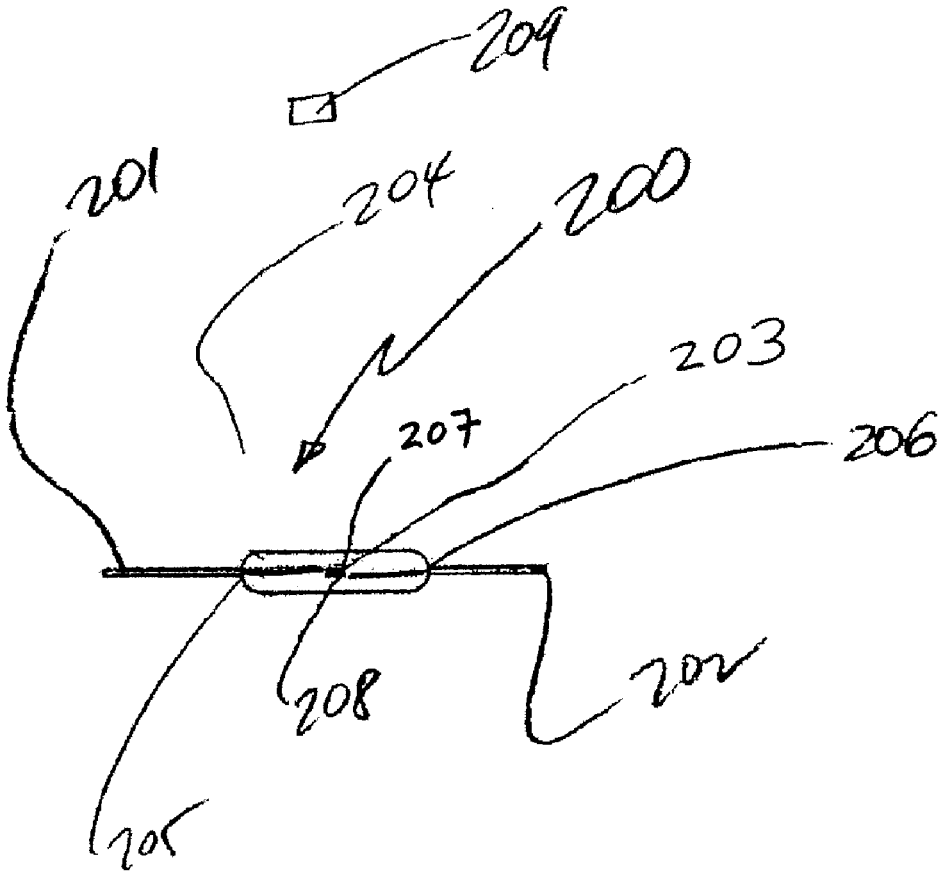
FIG. 2B is an example of the type of micro-miniature reed-type contact switch that can be used in the LED circuits of the preferred embodiment.

Switch 22A and closer 23A of the LED circuit 20A (shown in FIG. 2A) is preferably a hermetic type contact switch such as a micro-miniature reed-type contact switch 200 of the type shown in FIG. 2B. Referring to FIG. 2B, such reed-type switches or relays 200 are hermetically sealed so as to be impervious to atmospheric contamination. The magnetic reed-type contact comprises two flat ferromagnetic reed relay contacts 201 and 202 separated from each other by a gap 203 and tightly enclosed in the gas-filled glass capsule 204. The reed relay contacts 201, 202 are fixed in the sealed ends 205, 206 of the glass capsule 204 so as to act as cantilevers. When free ends 207, 208 of the contacts 201, 202 are placed in a magnetic field of sufficient intensity, such as may be caused by close proximity of magnet 209, the flux in the gap 203 will be generated and the contact free ends 207, 208 will be made to contact each other so as to close the circuit. When the magnetic field is removed, the free ends of the contacts 207, 208 will move back out of contact because of the tension of the contacts 201, 202.

The magnetic field can be provided by an electromagnet, or as in the preferred embodiment of this invention, by a small permanent magnet. The reed-type switch is normally a single-pole, single throw type switch having normally open contacts and containing two magnetically actuated reeds or contacts 201, 202. The magnet serving to close the gap between the contacts 201, 202 when in close proximity to the glass capsule so as to close the switch, (and opening the gap 203 between the contacts 201, 202 so as to open the switch) can be a small piece of flexible magnetized material of the type used for refrigerator magnets and the like. Either a normally open reed-type switch, or a slightly, more complex normally closed reed-type switch (which opens, rather than closes, in the proximity of a magnetic field) may be employed.

If the switch 21 is normally closed, opening of door 16 ends the contact between reed-type contact switch 21 and magnet 22 so as to open the circuit between battery 20 and LED 19 and thereby turn off the light of LED 19. Alternatively, circuit 12A could be normally open and opening door 16 would serve to close the circuit between switch 21 and magnet 22, so as to turn on LED 19. As a result, depending upon whether reed-type switch was normally open or closed, opening door 16 could cause the LED 19 to either light or turn off. Similarly, depending upon whether switch 21 and magnet 22 were normally open, closing door 16 could cause LED 19 to light or turn off.

LED circuit 19A can thus be placed behind a picture or label 18A so as to illuminate label 18A from behind. LED 19 could thereby backlight a picture on door 16. Alternatively, opening door 16 could open the LED circuit and turn off LED 19. Door assembly 17 could snap fit into a correspondingly shaped chamber recessed into the side of bottle 10 with the side wall of bottle 10 extending into the interior of the bottle 10 (as shown with the embodiment of FIG. 3).

Referring to FIG. 1, an LED circuit 19A affixed or contained within bottom chamber 12 of bottle 10 can be turned on or off by bringing the switch 22 in close proximity to magnet 21, depending upon whether the switch 22 is normally open or closed. Alternatively, LED circuit 12A can comprise push switch 13, battery 14; with LED 15 being activated by pushing switch 13 and deactivated by pushing switch 13 again. Inasmuch as switch 13 protrudes beyond the bottom of bottle 12, the LED circuit 12A can be normally open and the LED not lit until the bottle 10 is lifted off the flat surface it is resting upon, whereupon switch 13 closes the circuit 12A and turns on the LED light 15. Conversely, LED may be normally lit until removed from the flat surface, which serves to open LED circuit 12A.

Turning to FIG. 2A, with respect to all of the various embodiments of the invention, switch 22A can thus be a push switch such as switch 13 of FIG. 1; or a reed-type contact switch of the type described with respect to FIG. 2B, either closed or opened by contact with a closer 23A which can be a magnet; a push switch; or a sliding switch. Battery 24 of all of the various embodiments of the invention is a small, thin 1.5v battery such as those used in watches or hearing aids, which serves to power LED 21 when switch 22A is closed.

Figure 3:
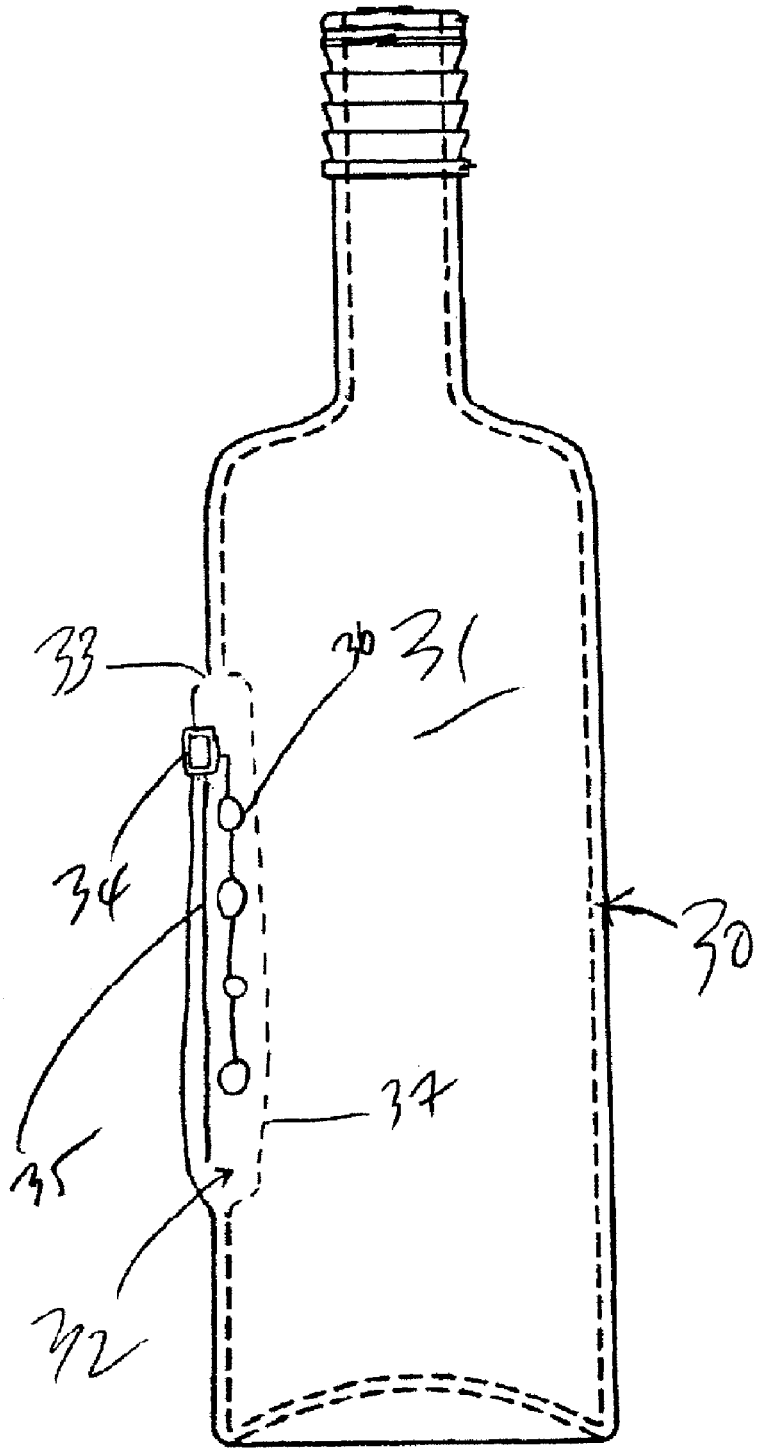
FIG. 3 is a side view of a second embodiment of the bottle with an LED chamber built into its side.

With respect to the embodiment of bottle 30 of FIG. 3, LED circuit 36 is contained within chamber 32 formed into bottle 30 and extending into its interior 31 by way of interior wall 37. Chamber 32 contains LED circuit 36 which is shown as comprising multiple LEDs. Single LEDs could also be used. Switch 34 serves to activate and light LED circuit 36. Label or artwork 35 is inserted into chamber 32 by opening 33 and positioned in front of circuit 36. That way the LED circuit 36 can provide backlighting of artwork 35 visible through the front of the chamber 32, which can be transparent or opaque—depending on the desired effect.

Figure 4:
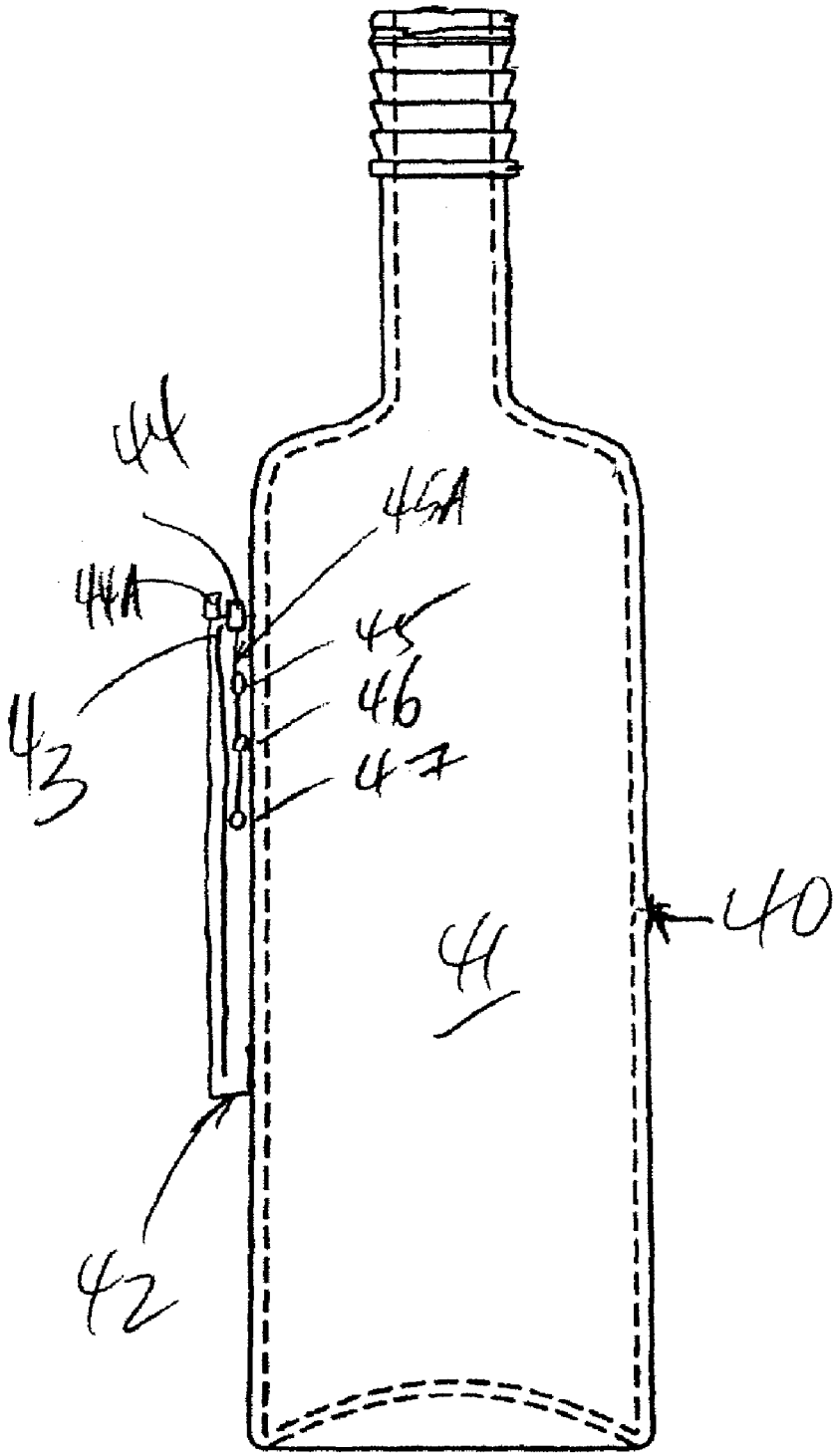
FIG. 4 is a side view of a third embodiment of the bottle with an external LED chamber attached to it.

In the embodiment of FIG. 4, LED chamber 42 is actually affixed by glue, tape, hook and loop fasteners or the like to the outside of a standard bottle 40. Interior 41 and label 43 are lit by activating switch 44 of LED circuit 45A and in particular, LEDs 45, 46 and 47. Single LEDs can also be used. Label 43 is slid into the interior of chamber 42 prior to assembly or through a slot or open side (not shown).

Figure 5:
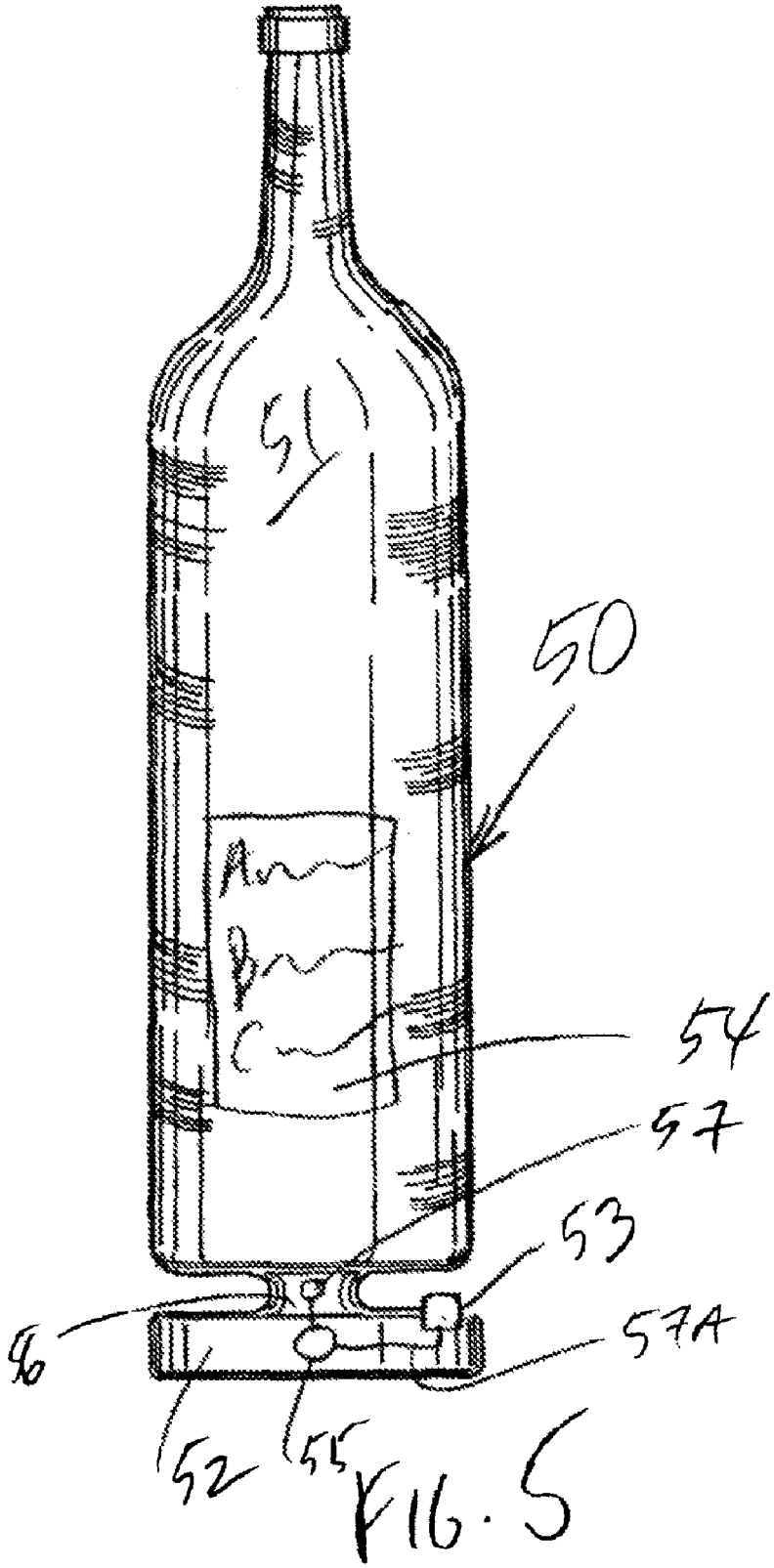
FIG. 5 is a side view of a fourth embodiment of the bottle with a base attached to it and containing an LED clamber.

Bottle 50 of the embodiment shown in FIG. 5 includes base 52 and LED chamber 56. Switch 53 of LED circuit 57A activates LED 57 coupled to battery 55 so as to illuminate base 52, LED chamber 56 and/or interior 51 of bottle 50. Label 54 on bottle 50 is illuminated by LED 57. LED 57 can be instead located within base 52 to illuminate the base 52.

Figure 6:
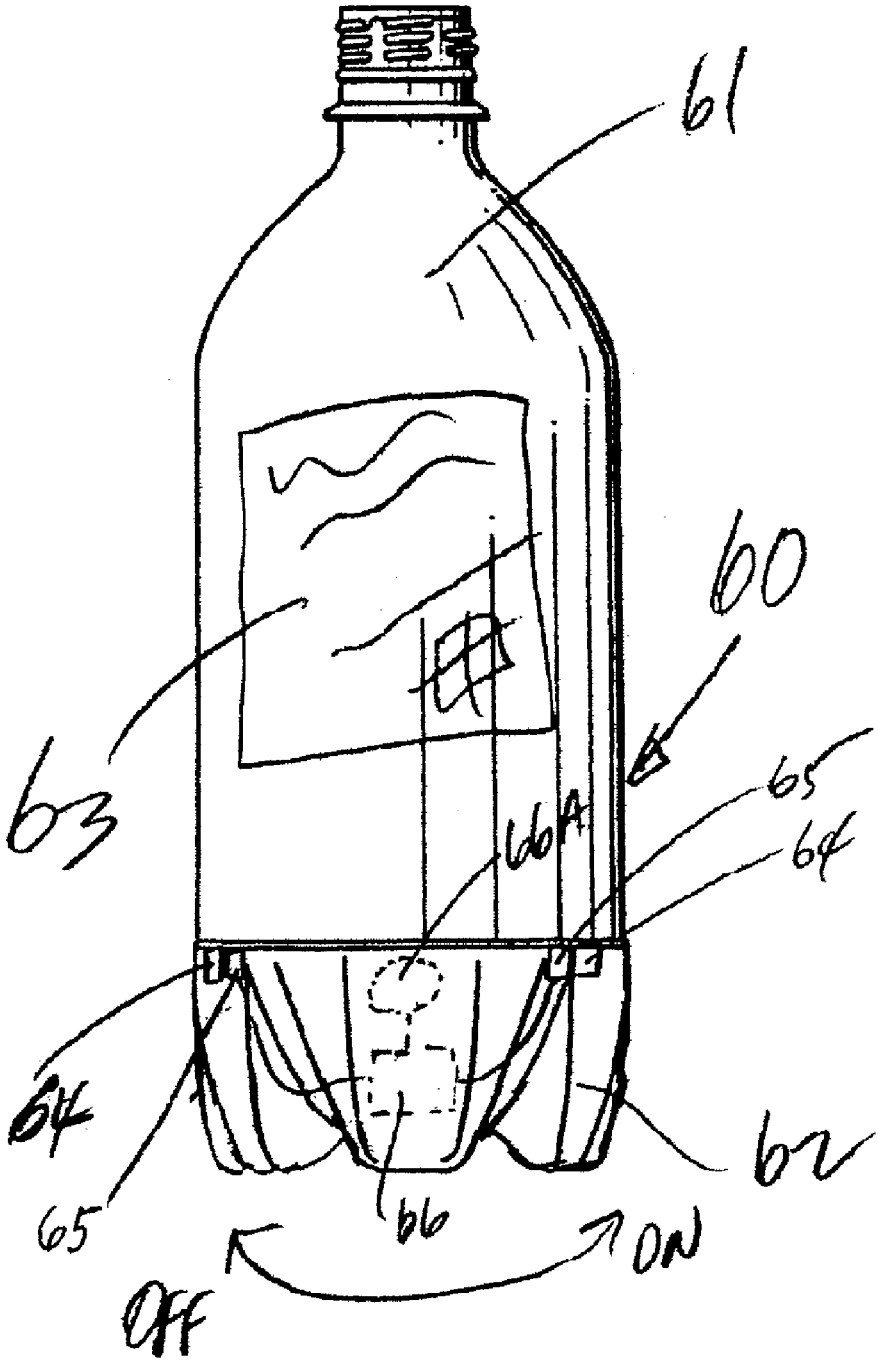
FIG. 6 is a side view of a fifth embodiment of the bottle with a twist base containing an LED chamber for lighting either the base or the interior of the bottle as desired.

Bottle 60 of FIG. 6 includes body 61 bearing label 63 adhesively attached thereto. Base 62 is rotatably mounted to body 61 by a tongue and groove or similar rotatable arrangement between the interior of base 62 and exterior bottom of body 61 (not shown). Rotating base 62 clockwise as shown in FIG. 6 brings switch 64 securely mounted to base 61 and magnet 65 securely mounted to body 61 (or vice versa) into close proximity or physical contact, to so as to close the circuit and light LED 66A, powered by battery 66 housed within base 62. In that way, interior of base housing 62 and interior 61 of bottle 60 including label 63 are illuminated. Rotating base 62 counterclockwise as shown in FIG. 6 disconnects contact switches 64 and 65 so as to turn off LED 66.

Figure 7A:
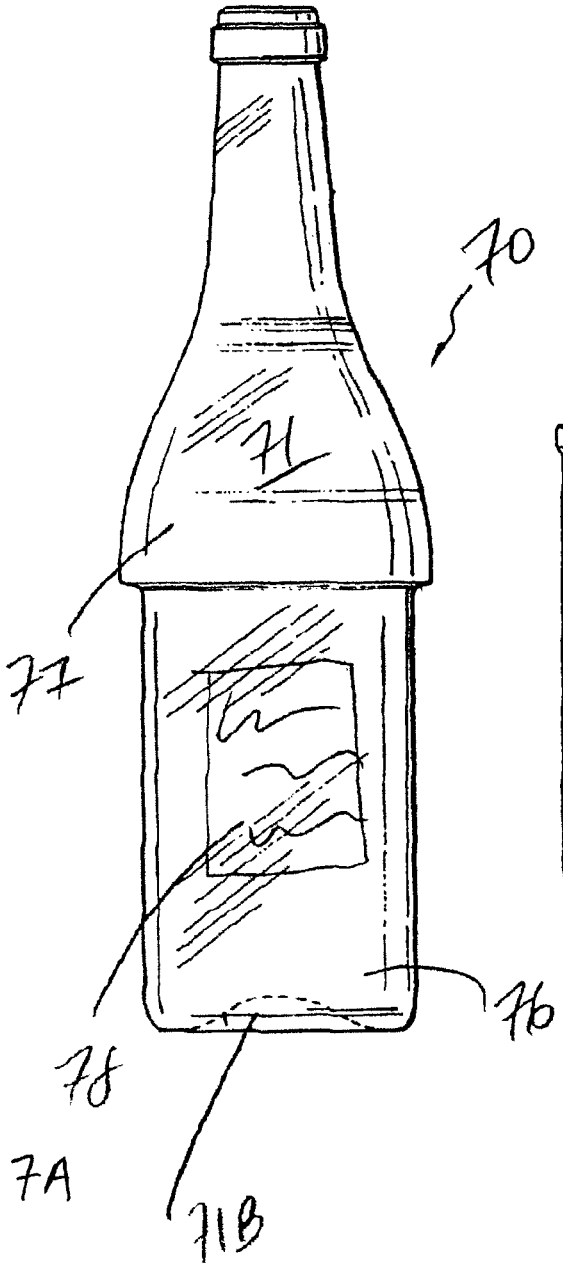
FIG. 7 is a side view of a sixth embodiment of the bottle having a two-piece construction, an LED chamber proximate a bottom surface, and a display chamber proximate the bottom of the bottle.
Figure 7B:
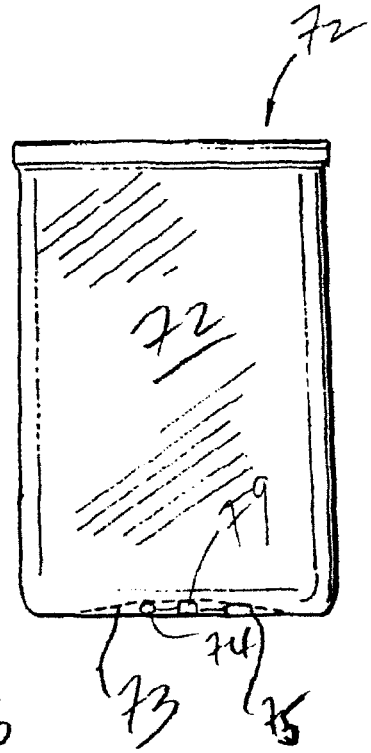

A two-piece bottle 70 comprising outer portion 72 of FIG. 7B, telescopically receiving inner portion 76, in turn integrally formed with upper portion 77 of FIG. 7A. The LED circuit comprising switch 75, battery 79 and LED 74 is housed within LED chamber 73 formed in the bottom of outer portion 72. Switch 75 protrudes beyond the bottom of outer portion 72. When bottle 70 is placed on a hard, flat surface, switch 75 is closed and LED 74 is not illuminated. As soon as bottle 70 is lifted off the surface, switch 75 is opened and LED 74 illuminated. Label 78 is interposed between outer portion 72 and inner portion 76.

If a reed-type contact hermetic switch is used for switch 75, outer portion 72 shown in FIG. 7, can then be used as a glass to drink the beverage contained in bottle interior 71. If a magnet (not shown) is mounted within bottom cavity 71B of bottom portion 76, then separating portion 76 from portion 72 would open the LED circuit and illuminate LED 74. Replacing portion 72 on portion 76 would turn off the LED or vice versa.

Figure 8A:
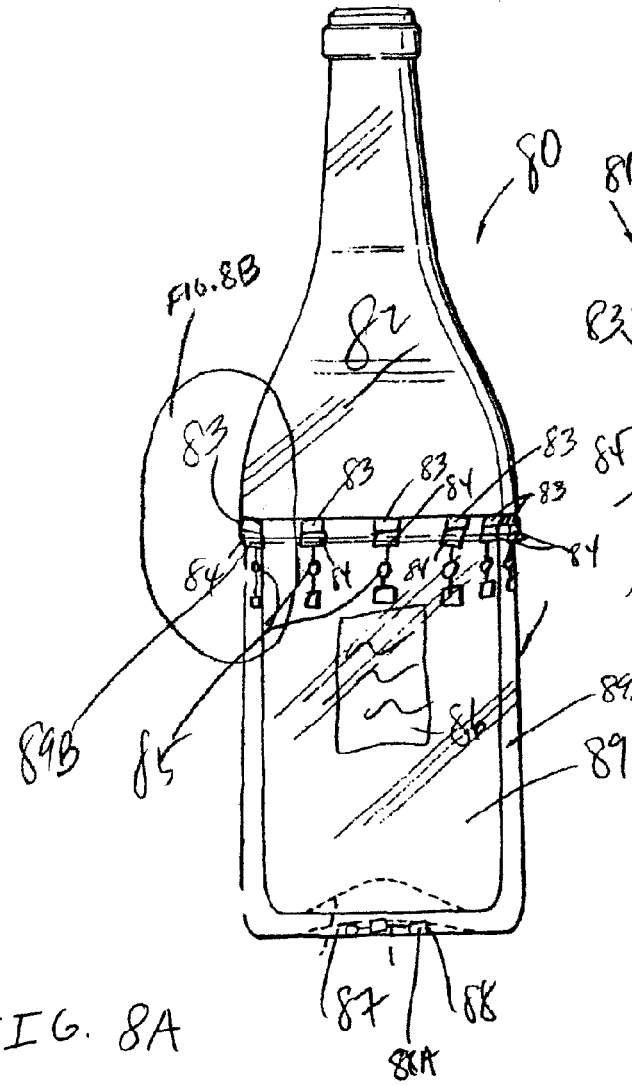
FIG. 8A is a side view of a seventh, two-piece embodiment with switches and LEDs interposed in a display chamber between both portions of the bottle.

With respect to FIG. 8A, two-piece bottle 80 is shown having insert portion 82 and outer portion 89. Sensors or contact switches 83 and 84 are shown in contact so as to close the circuits of LED circuits 85 interposed in display chamber 89A between insert 82 and outer portion 89. When switch and magnet 83 ad 84 are aligned as shown in FIG. 8A, LED circuits 85 are closed and LEDs 85A are on and illuminate the interior of bottle 80 and label 86. To hide the LED circuits 85 from view, a translucent sheet (not shown) can be interposed between LED circuits 85 and outer portion 82.

Figure 8B:
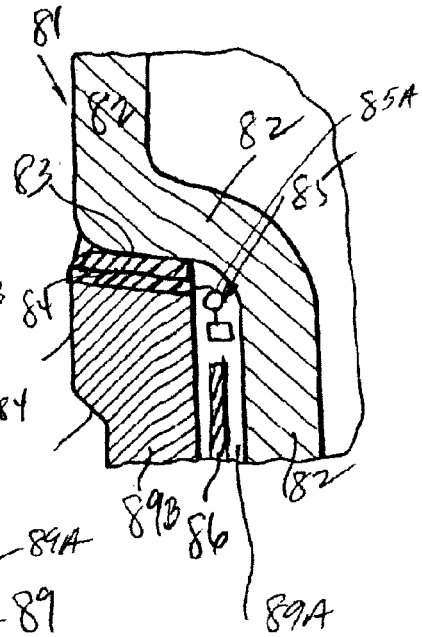
FIG. 8B is a partial cross-sectional view of the bottle of FIG. 8A.

As shown in FIG. 8B, label 86 is interposed between insert 82 and outer portion 89B. Because switch 83 and magnet 84 are in contact, LED circuit 85 is illuminated, thereby lighting label 86.

If outer portion 89 is twisted relative to insert 82, so that switch 83 and magnet 84 are no longer aligned, then LED circuits 85 are turned off. FIG. 8A further shows additional alternative LED circuit 88 within LED chamber formed in the bottom of outer portion 89. In addition to being a reed-type switch, the switch 88A of LED circuit 88 (or any other LED circuit herein) can be a motion switch or a contact switch serving to close the circuit of LED circuit 88 and battery 87, and illuminate the contents of the bottle, if bottle 80 is lifted off a hard surface such as a table or a bar.

Figure 9A:
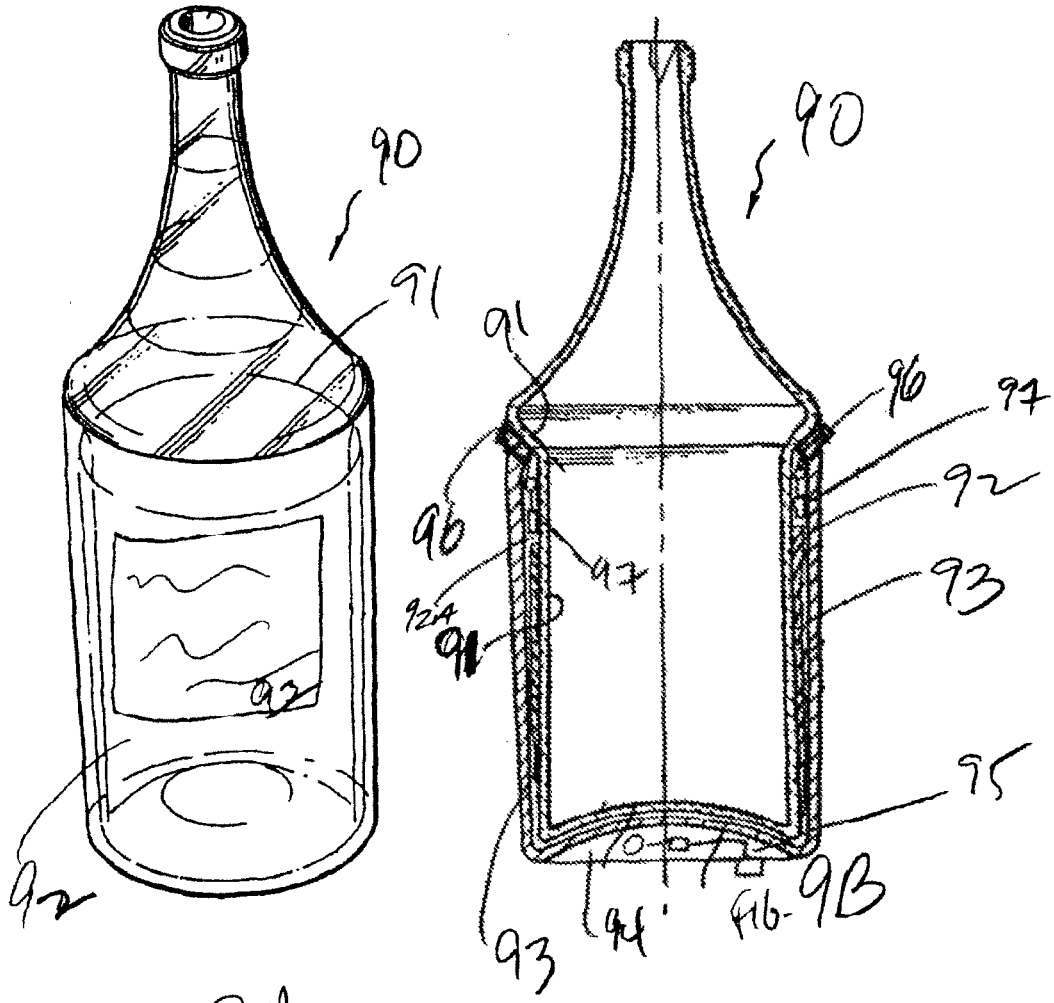
FIG. 9A is a perspective view of an eighth, two piece embodiment of the bottle.

Turning to FIGS. 9A and 9B, an alternative embodiment of a two-piece bottle 90 is shown in FIG. 9A as upper portion 91 being received within outer portion 92. As shown in FIG. 9B, contact switches 96 are interposed between the junction of upper portion 91 and outer portion 92. When switch 96 is contacted by both portions of bottle 90 (or if a reed-type contact switch is used and a magnet is brought in close proximity to the glass capsule containing the free ends of the contacts as discussed in connection with FIG. 2B), LED circuits 97 interposed between bottle portions 91 and 92, are illuminated so as to light up label or artwork 93 interposed in the display chamber 92A created between portions 91 and 92. An optional LED circuit 95 can be placed in LED chamber 94 at the bottom of portion 92, so as to operate in the manner described with respect to the embodiment of FIG. 8.

Figure 10A:
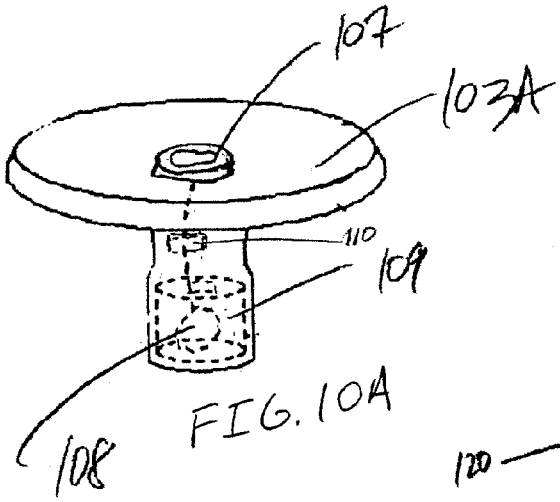
FIG. 10A is a perspective view of the plug portion of a ninth embodiment of the bottle, having an LED chamber therein.
Figure 10B:
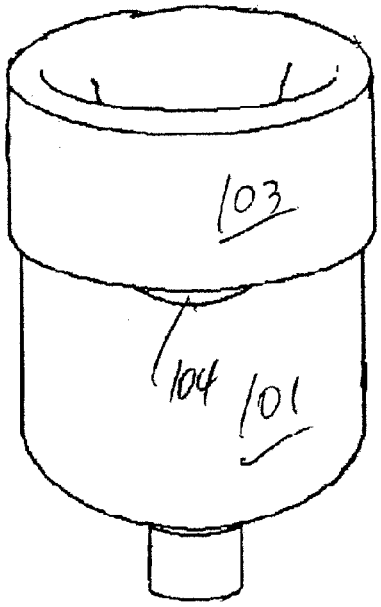
FIG. 10B is an inverted perspective view of the ninth embodiment of the bottle.
Figure 10C:
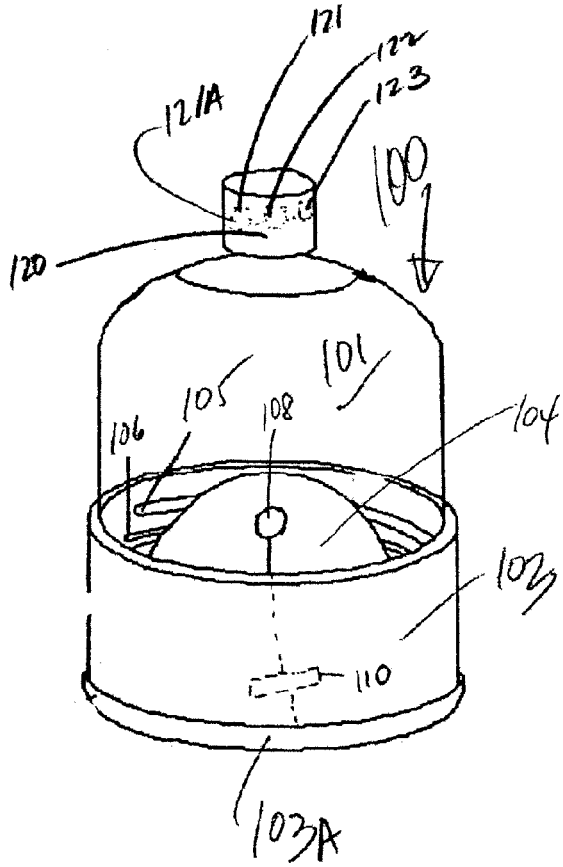
FIG. 10C is a perspective view of the ninth embodiment of the bottle.

In FIGS. 10A through 10C, a bottle 100 has base 103 and container 101. Container 101 is formed with dome 104 projecting into the interior of container 101 from the bottom of container 101. Base 103 can be ring-shaped and securely attached to the exterior of container 101 by threads 105, 106, as shown in FIG. 10C, or other ways of fastening base 103 to container 101.

Plug 103A snaps into or otherwise attaches to the bottom of base 103. Base 103 can be translucent or transparent. Plug 103A is placed into the bottom of base 103 and houses one or more LED circuits in chamber 109. Switch 107 (as well as the other switches mentioned herein) can be a membrane switch or push switch which, when depressed a first time, activates the LED circuit of LED 108 and battery 110 within LED chamber 109 and, when depressed a second time, turns off the LED circuit. Alternatively, switch 107 can be a reed-type contact switch which is opened (or closed) when a magnet (not shown) is brought in closed proximity to its glass capsule containing its contacts as described in connection with FIG. 2B. The magnet can be rotatably mounted and retained on a disk outside switch 107 that can be manually turned so as to come into proximity with switch 107 and close it to turn on LED 108. As shown in FIG. 10C, LED 108 shines through dome 104 to illuminate the contents of container 101 when the LED circuit is activated.

As shown in phantom in FIG. 10C, a LED circuit can also be mounted inside transparent or translucent bottle top 120. Switch 121 and magnet 121A are mounted on opposite parts of the screw on cap and the threaded cap-receiving portion of bottle 100. When switch 121 and magnet 121A are aligned and in close proximity, as when the screw-on cap 120 is attached to bottle 100, then the circuit is closed and LED 122 is powered by battery 123.

Although the present invention has been described and illustrated as having switches or LED circuits in the central or bottom portions of the bottle, it is also possible to have the switches and LED circuits operate with the cap of the bottle as shown in FIG. 10C such that removal of the cap from a bottle breaks contact between switch 121 and magnet 121A that then serves to close the LED circuit and light the LED 122. Conversely, when the cap is snapped or screwed back on, the switch 121 and magnet 121A opens the circuit and the LED light 122 is thus turned off. While only glass bottles are disclosed, transparent or translucent plastic bottles should also be considered as within the scope of the present invention. Moreover the LED circuits can be turned on or off by RF remote control (not shown).

In yet another alternative embodiment, which may be considered a variation of the embodiment of FIG. 4, one or more LED circuits 45A including magnet 44A, reed-type switch 44, battery 44B and LEDs 45-47, can be placed and held against side or bottom of a bottle 40 as shown in any of the embodiments of the invention, by a layer of shrink-wrap opaque or translucent plastic or the like (not shown). Battery 44A is initially placed far enough away from switch 44 that it stays open and LED stays off. If, however, the shrink wrapping is then pressed inwards toward the bottle 40 at a position near magnet 44A, so as to activate and close switch 44, then one or more of the LEDs 45-47 will be illuminated. Conversely, switch 44 can be normally closed so that LEDS 45-47 are illuminated, unless and until magnet 44A is depressed or otherwise moved away from switch 44 so as to open the LED Circuit and turn off LEDs 45-47. The shrink wrap can cover all or a portion of the base. Alternatively, it can cover all or a portion of the sides of the bottle and have a decorative image thereon so as to be backlit by the LED circuit when the LED is illuminated.

In addition, for bottles that are closed or sealed with a cork, a magnet can be embedded in the cork. And a reed-type switch can be mounted just outside the mouth of the bottle (not shown). So long as the magnet and cork remain close to the switch, the circuit remains closed and LEDs powered by a small battery are illuminated. If the cork is removed from the bottle, the circuit is opened and the LEDs are turned off. Conversely removal of the cork could close a normally opened switch and thereby illuminate LEDs that had been in the normal, off position.

Other modifications and alterations may be used in design and manufacture of the apparatus of the present invention without departing from the spirit and scope of the following claims.

I claim:

1. A bottle comprising:

a container portion;

a door assembly operably connected to said container portion and having a first open position and a second closed position;

a power source;

at least one light source for illuminating selected portions of the container portion and operably associated therewith;

at least one switch operably connected to the power source and the at least one light source for selectively illuminating at least one of the at least one light source when said door assembly is in the open position; and wherein the container portion of the bottle has an outer surface, and at least one of the at least one light source is disposed proximate the outer surface of the container portion of the bottle.

2. The bottle of claim 1 wherein at least one of the at least one light source is a light emitting diode.

3. The bottle of claim 1 wherein at least one of the at least one switch is a reed-type hermetic switch.

4. The bottle of claim 1 wherein the bottle further contains a base portion for receiving at least a portion of the container portion, at least one of the at least one light source is contained within the base portion and illuminates the container portion, and at least one of the at least one switch is disposed within the base portion and is operably connected to at least one of the at least one light source.

5. The bottle of claim 1 wherein said bottle comprises a standard bottle.

* * * * *